United States Patent [19]

Kelly

[11] 4,141,232

[45] Feb. 27, 1979

[54] GUARD AND LOCKING COMBINATION THEREWITH

[76] Inventor: Richard L. Kelly, 8761 Matilija Ave., Panorama City (L. A.), Calif. 91402

[21] Appl. No.: 820,923

[22] Filed: Aug. 1, 1977

[51] Int. Cl.[2] ..... E05B 67/38

[52] U.S. Cl. ..... 70/54; 70/417

[58] Field of Search ..... 70/51, 54, 56, 52, 55, 70/417; 292/281, 283

[56] References Cited

U.S. PATENT DOCUMENTS

| | | | |
|---|---|---|---|
| 3,902,339 | 9/1975 | Carley | 70/54 |
| 4,033,155 | 7/1977 | De Lucia | 70/56 |

*Primary Examiner*—Robert L. Wolfe

*Attorney, Agent, or Firm*—Frank L. Zugelter

[57] ABSTRACT

An article of manufacture to eliminate ease of destruction of a slotted hasp and/or staple combination utilized to lock a door, secured together by a padlock, whereby unauthorized entry is prevented. The inventive subject matter includes a pair of spaced rigid members in secured relationship to each other, with each having an aperture placeable in contiguity and alignment with the pocket or cavity of the staple which displaces the void or spacing between the secured members. One species of the invention includes a horizontally-disposed segment at its rear end and which maintains in spaced position the members to each other, the members terminating at their other ends or faces in an open manner in order for a slip-on connection to the staple after the hasp's slot is in placed or closed upon the staple. With such connection, the rear end abuts the staple's bow while the configuration of the guard's faces at its open end cooperates with the form of the hasp. After such slip-on connection, the lock is mounted through the guard's apertures and staple's pocket and thence locked. A snug fitting among staple, hasp, guard, and lock results thereby preventing a cutting tool's work surfaces to engage the soft metal of hasp and/or staple to cut them. The guard may be heat-treated to eliminate soft metal characteristics therein, and thereby be not subject to ordinary modes of soft-metal cutting. Other species of the claimed invention are also shown.

42 Claims, 12 Drawing Figures

GUARD AND LOCKING COMBINATION THEREWITH

BACKGROUND TO THE INVENTION

The known mode to lock the door(s) of garages, sheds, storage rooms, or any closure utilized for prevention of unauthorized entry is to apply a padlock or the like around and within the bow of a staple which is part of a mounting bracket bolted or otherwise secured to the closure door proper, after a slot in a cooperating hasp on a wall or another door for the closure has engaged such staple by insertion thereon. A loose combination of staple, hasp and lock results, i.e. a good deal of free play exists for the hasp between the door (or mounting bracket for the staple) and the bow of the lock. Also, the soft metals forming the hasp and the staple are readily exposed to the cutting edges of a cutter which can cut through to the pocket of the staple. And even though the padlock ("U"-shaped) locking arm may be of the strongest, cutting-resistant metal capable of being made, it is an easy matter for application of any one of many kinds of metal cutters to the soft metals of hasp or staple, cutting one or both through to their respective slot or pocket, then bending one or both soft metals in a direction to free the locked padlock from the combination. Once the padlock is freed from this combination, the soft metals of one or both of the hasp and staple are returned to a position after which easy release of hasp from staple is effected. Entry to the closure is then the next step.

THE PRIOR ART

A review of prior art locking arrangements does not show that any attempt to solve the ready access by means of metal cutters to such a loose arrangement of locked staple and hasp has ever been made. In particular, a review of issued patents in the railway cardoor locking art, such as shown in U.S. Pat. Nos. 293,593; 657,742; 1,079,390; 1,122,469; 1,768,205; provides the clear conclusion that the construction of such locking devices was concerned with immediate knowledge of an unauthorized break-in to the railway car rather than providing as much as possible a locking means to prevent a break-in. Solution to the problem which the patentee here makes was never seen, considered, anticipated, or made obvious ever before.

The patentee's invention here solves the problem of such easy break-in situations which are so abundantly and/or potentially available on premises of all residential, business, industrial, commercial, agricultural and all other concerns, where simple locking arrangements as taught by the prior art are utilized.

SUMMARY

This invention relates to a manufacture for eliminating damage to or preventing break-in to a closure from a hasp, staple and lock arrangement, and in particular, relates to a guard for mounting on such arrangement whereby elimination of the use of metal cutters on the hasp, staple, and/or lock is effected.

An object of this invention is to provide complete assurance that a false or unauthorized entry or access to a closure locked with the invention will not be accomplished through the use of the invention.

Another object of this invenion is to provide a sure-proof accessory for an already existing locking combination whereby the latter is not broken or damaged by use of the invention.

A further object of this invention is to eliminate removal of a padlock or the like from an ordinary locking arrangement of hasp, staple and padlock or the like.

A further object of this invention is to minimize additional costs towards achieving a perfected sure-proof locking arrangement, without the necessity of completely changing to a different and more costly locking system.

Another object of this invention is to provide a heat-treated accessory for an ordinary or common locking arrangement whereby the latter is no longer susceptible to easy metal cutting.

A further object of this invention is to provide a novel locking system or combination of hasp, staple, lock and guard.

A still further object of this invention is to eliminate all free play in an ordinary, common locking arrangement by attachment of a guard, heat-treated or not heat-treated, thereto, whereby application of a metal cutter to the hasp and/or staple of the locking arrangement is eliminated.

Another object of the invention is to provide an efficient, inexpensive way to assure that a locking arrangement is tamper-proof.

These and other objects and advantages of the invention will become more apparent upon a full and complete reading of the following description, the appended claims thereto, and the accompanying drawing comprising one sheet.

DESCRIPTION OF THE PREFERRED EMBODIMENT

Figure 1:
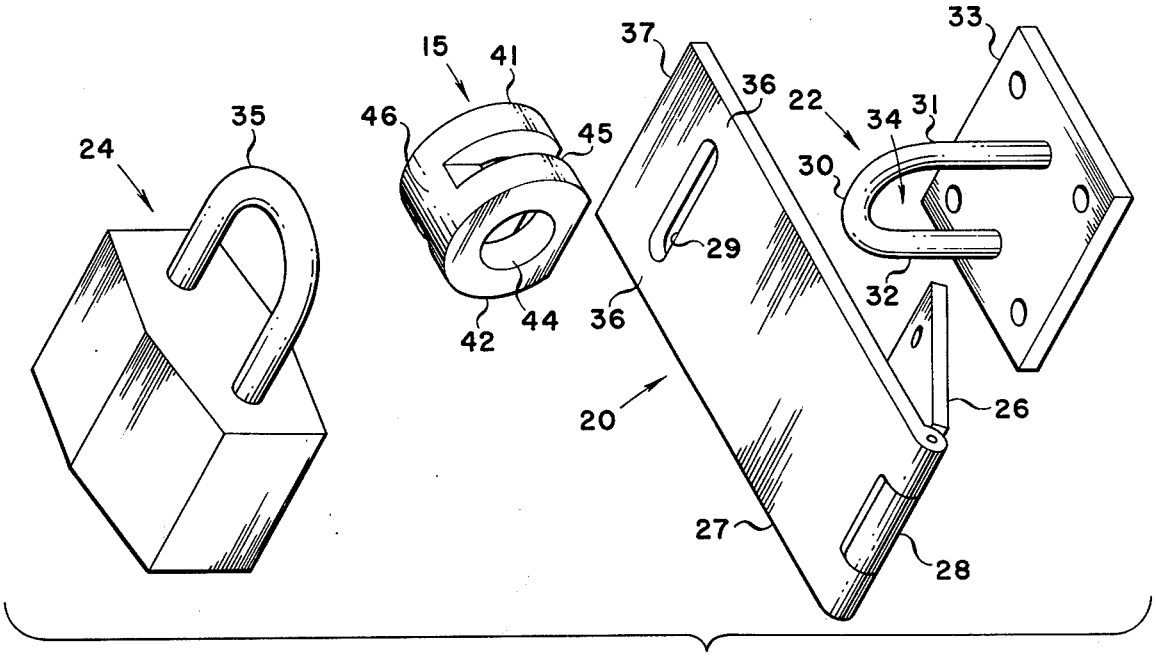
FIG. 1 is an exploded perspective view of subject matter of the invention.

Referring now to the drawing where numbers correspond to like reference numerals hereinafter, FIG. 1 illustrates subject matter 15 of the invention in relation to its combination and arrangement with an ordinary hasp 20, a staple 22, and a lock-bolt, padlock (or the like) 24. The hasp 20 comprises a first member 26 adapted in known fashion for securement, say, to a moving door (not shown) and a second member 27 swingably hinged as at 28 about member 26. A slot 29 is provided in the second member 27 for known cooperative connection with the staple 22. The staple 22 comprises a bow 30 joining a pair of spaced arms 31,32 secured to and extending in known fashion from a supporting plate 33. The plate 33 is adapted for secured mounting in known fashion to a non-moving or stationary portion (not shown) for a closure, doorway or the like. It should be understood that the relative positions of hasp 20 and plate 33 may be reversed in the utilization of the invention.

Figure 3:
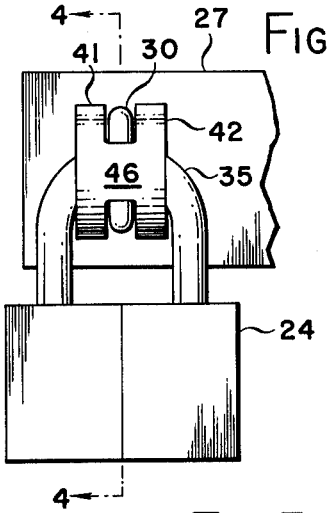
FIG. 3 is an elevational view of the subject matter of the invention as it is applied to a locking arrangement.

A pocket or cavity 34 is formed by the staple 22 and the plate 33 so that in actual usage of this known locking arrangement, after the staple 22 is inserted into and through the hasp's slot 29, a sufficiency of the pocket 34 remains in order for a known swingable "U"-shaped member or shackle 35 of the lock 24 to be thrust therethrough and locked back upon itself. Such locked arrangement of hasp, staple and lock is evident in FIG. 3 and from FIG. 1. This known arrangement of the above-described elements, of course, is a sloppy fit, so to speak, as free play exists with the padlock 24 and hasp 20 upon the staple 22. Further, the manufactures of hasp and staple are usually produced from soft metal and result in a soft metal arrangement. Consequently, they, and particularly the slotted hasp 20, are subject to cutting by known and suitable metal cutters whose jaws are able to grip or grab hold of, say, the hasp in proximity of its slot 29. By cutting into the hasp 20, say at 36, and continuing to cut to its slot 29, its end section 37 is then handily displaced of its original position on the staple 22 and/or severed from the hasp 20. The remaining portion of the hasp 20 is swingable about the hinge 28 despite the fact that the padlock 24 remains united to staple 22. Entry to the closure, of course, follows.

The application of the guard 15 to the aforesaid described elements of a known locking combination and arrangement eliminates this possibility of broken or damaged hasp or staple and assures of an improved, novel, sureproof, non-tampering locking system, in addition to its own novelty.

Figure 2:
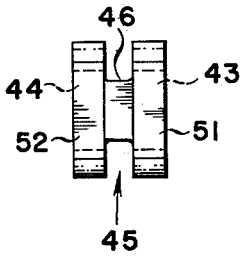
FIG. 2 is an elevational view from the open end of subject matter of the invention.
Figure 4:
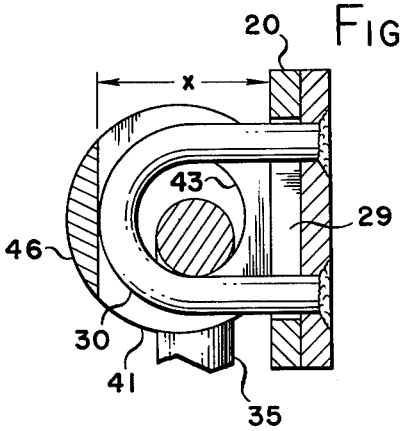
FIG. 4 is a view taken on line 4—4 of FIG. 3.

Guard 15 comprises a pair of spaced rigid members 41,42 of bounded lengths and widths and in secured relationship to each other. Each member 41,42 includes an aperture 43,44, respectively (FIGS. 1, 4), through its thickness such apertures being in contiguous and aligned disposition with the cavity 34 of staple 22 upon introduction of guard 15 thereto. In other words, the cavity 34 of the staple 22 displaces the spacing or void provided between the lengths and widths of the members 41,42 in their secured relationship. An open end 45 (FIGS. 1, 2) is provided in the guard for providing a way of introduction of the staple 22 into such void or spacing for the guard 15 upon the staple 22. The spacing or void exists between the members 41,42 throughout their lengths and widths, including the portions of such lengths and widths at which their apertures are disposed, except for the means by which such members are secured in their spaced relationship and which does not exist at such portions.

In the species of FIG. 1, a horizontally-disposed (in reference to the planes of the rigid members 41,42) rigid segment or portion 46 is integrally formed with members 41,42 at the rear end of the guard 15 opposite to the open end 45 thereof, in order to maintain and secure their space relationships. Each of members 41,42 includes end faces 51,52, respectively. These faces 51,52 are flush with the open end 45 and upon introduction of guard upon staple, they cooperate with the hasp 20 by physically abutting its adjoining side. An unshifting position for the guard on the staple results, by the relationship of members 41,42 and faces 51,52 to the staple and to the hasp, respectively. By unshifting it is meant that the guard 15 cannot rotate about an axis passing through its aligned apertures 43,44 nor is it possible for the guard 15 to revolve about a distant axis parallel to the aforementioned axis. It should be apparent that once introduction is made, the lateral movement of the spaced members 41,42 of the guard 15 or rotation thereof around a vertically disposed axis is impossible.

This unshifting characteristic is assured by the manufacture of the guard 15 incorporating a distance x (FIG. 4) to be substantially the same as the linear distance between the top of the bow 30 and adjoining surface of the hasp 20 closed upon the staple 22.

The important feature of the relationship between faces 51,52 and hasp 20 is the inability of any cutting elements of a metal cutting device to gain access to the soft metal of the staple 22, by prying or otherwise. A very small degree of space may exist between faces 51,52 and hasp 20 if no prying is feasible or no introduction of cutting elements is possible.

In the FIGURE illustrations, faces 51,52 and hasp 20 are flat or straight. These faces may also take the forms of various curvature or angles all of which are complementary or appropriately fitting to one another in order to effect the necessary abutting or snug relationship among one another in order to deny a metal cutter to the soft metal of hasp and/or staple.

In actual usage or operation of the invention, the hasp's slot 29 is closed upon the staple's bow and its arms 31,32. The guard 15 is then slipped upon or over the exposed portion of a single element, the staple, to provide a snug facing and unshifting relationship between the surface of the hasp 20 and the end faces 51,52 of the guard 15. In such relationship, the apertures 43,44 become contiguous to and in alignment with the cavity 34 of the staple 22. Thence, the "U" -shaped member or shackle 35 of the padlock is inserted through one of such apertures, the cavity 34 within the void or spacing between the members 41,42, and thence through the other of such apertures, after which it is locked in the usual way, back upon itself.

This improved locking combination and arrangement is no longer subject to damage or breakage by a metal cutting mechanism. None of the soft metal portions of the aforesaid described elements, such as the hasp 20 and/or staple 22 are exposed to such a mechanism. Yes, a grinder upon any metal portion of the locking arrangement may completely sever the parts secured together; however, the noise eminating therefrom would be the signal by which tampering of the combination and arrangement would be known.

The guard 15 is formed via conventional machine processed operations. Preferably, its metal material is a heat-treated metal, such as PH 17-4 steel, manufactured by Armco Steel Corporation, Middletown, Ohio. In which case, the thicknesses of the members 41,42 need not be as great as otherwise. The guard 15 may be made also from known materials, such as that from which drill bushings are commonly made. Stainless steel tubing is also a good choice of materials.

Figure 5:
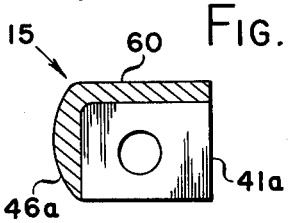
FIGS. 5 and 6, 7 and 8, 9 and 10, are side and end views (sectional where shown) of respective modifications of a guard forming subject matter of the invention.
Figure 6:
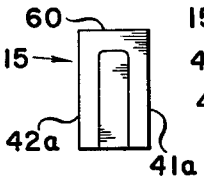

FIGS. 5 – 12 illustrate various subject matter modifications contemplated within the scope and spirit of the invention. FIGS. 5 and 6 illustrate a semi-enclosed guard 15 which includes a closed top 60 joining together thereat the spaced members **41*a*, 42*a* and the closed end 46*a*. Top 60** may also be a base portion.

Figure 7:
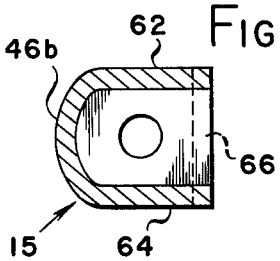
Figure 8:
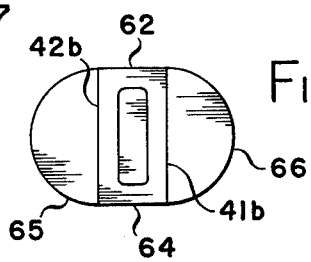

FIGS. 7 and 8 illustrate a fully-enclosed guard 15 having a closed top 62 and a closed base 64, both of which join together themselves with the spaced members **41*b*, 42*b* and closed end 46*b*. Additionally, protective tabs 65,66** are included flush with the guard's open end to thereby prevent prying or cutting efforts to take place immediately at such open end. These tabs, of course, may be incorporated on any other embodiment as well.

Figure 9:
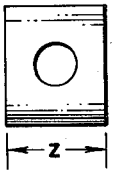
Figure 10:
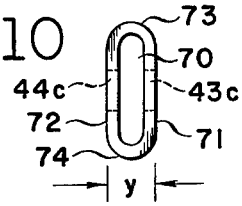

FIGS. 9 and 10 illustrate a flattened tubing which can be utilized in the practice of the invention. A circular tubing is cut from stock or stainless steel, before or after a pair of suitably opposing apertures 43*c*, 44*c* are drilled or otherwise formed therein. A conventional stamping step upon the circular tubing piece decreases its diameter to a desired width y as shown in FIG. 10. An open recess 70 results throughout the length of the tubing piece, being bounded by flattened portions 71,72 thus formed, and by closed top and base portions 73,74, respectively, also thus formed. The recess 70 is of such a width that it embraces the dimensions of the staple 22 when applied in actual operation. In this species, both longitudinal ends of the recess 70 are open. Its length z (FIG. 9) is sufficiently long to completely cover the exposed portion of the staple 22 when placed in its unshiftable position thereon after the hasp 20 has been closed thereupon.

Figure 11:
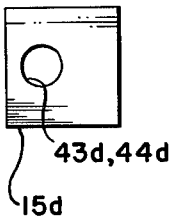
FIG. 11 is a side view of a guard showing eccentric or off-centered disposition of its apertures.

FIG. 11 illustrates the additional feature of eccentricity or off-centered disposition for the apertures of the guard 15. As applied to the species of FIGS. 9 and 10, the center line (FIG. 11) for each of the apertures 43*d*, 44*d* does not lie midway the length z of the guard 15. Such center line lies to the left of center for such length, and of course, may likewise lie to the right of such center. In so manufacturing guard 15*d*, this feature provides for a ready determination of a best fit or slip-on of guard 15*d*, or if applied to any of the other guards illustrated or otherwise within the spirit or scope of this invention, to a staple 22 or the like. Merely reversing the ends of the guard 15*d* to test which is the best fit as it is slipped onto a staple or the like assures this determination.

Figure 12:
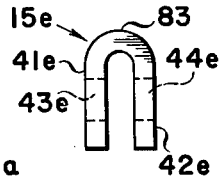
FIG. 12 is an end view of another species of the invention.

FIG. 12 illustrates a guard 15*e* having members 41*e*, 42*e* secured together and maintained in spaced relationship by solely a top portion 83, which portion 83 may also be considered a base portion by merely turning the guard upside down. Preferably, the guard 15*e* is made from a single piece of rigid material, such as metal, and which is bent over towards itself to thereby form portion 83 and members 41*e*, 42*e*. Its apertures 43*e*, 44*e* may be disposed on-center or off-center of its length and/or width, as desired. A step of drilling such apertures may precede or follow the bending-over step which forms the portion 83. Guard 15*e* may also be an assembly of separate parts such as described above as elements of the invention, in this species as well as in any of the other species of the invention comprehended within this disclosure.

Other advantages and objects in addition to various changes in the subject matter of the invention and within its scope and spirit should now be apparent. For example, the staple 22 may take the form of a solid member or tongue having a hole or pocket in alignment with the apertures of the guard. The diameter of the U-shaped member or shackle 35 may approximate the dimensions of the apertures of guard and of cavity of staple, however, it is clear that member 35 should never be as large as such apertures or cavity. Also, magnetization of the guard 15 is useful to keep it on the staple 15 when the locking arrangement is in an open or unlocked condition, thereby minimizing the possibilities of loss and misplacement.

Pursuant to the requirements of the patent statutes, the principles of and the invention have been described, explained and exemplified in a manner so that it can be readily practiced by those skilled in the art to which it pertains, such exemplification including what is presently considered to represent the preferred and best embodiment of the invention.

Therefore, what I claim as patentably novel is:

1. A combination for a locking purpose comprising
a staple or the like having a cavity therein,
a hasp slotted for a cooperative fit in a closed position to said staple or the like, and
a guard having an open end for slip-on connection over said staple or the like with the hasp in closed position and comprising
spaced rigid members in secured relationship to each other, each of said members having a thickness through which an aperture is co-extensively disposed, each aperture in alignment with the other,
said rigid members being spaced so as to constitute a void providing for the aforementioned slip-on connection,
at least one rigid segment securing said members and maintaining them in such spaced relationship,
said segment not being formed or disposed in the thickness of said members in which the aforementioned apertures are formed and disposed, and
a face on each of said members at the open end of the guard for substantial physical abutment upon the hasp in closed position,
said segment being in relationship with the aligned apertures and said spaced rigid members such that the staple or the like of the locking combination substantially displaces such void when said guard is slipped over such staple or the like and such staple or the like lies between said rigid segment, members and the aligned apertures of said members for operative action of the guard in the combination.

2. The combination of claim 1 wherein said guard is of heat-treated metal material.

3. The combination of claim 1 including a padlock or the like fitted to said apertures and cavity.

4. The combination of claim 3 wherein said padlock or the like fitted to said apertures and cavity is in a locked condition.

5. The combination of claim 1 wherein said rigid segment securing said members and maintaining them in spaced relationship is horizontally disposed.

6. The combination of claim 5 wherein said guard is of heat-treated metal material.

7. The combination of claim 5 including a protective tab mounted upon at least one of said members at the open end of said guard slippable upon said staple or the like.

8. The combination of claim 5 wherein said segment is a top portion.

9. The combination of claim 5 wherein said segment is a base portion.

10. The combination of claim 1 wherein said guard includes at least rigid top and base portions joining together and securing said members in spaced relationship.

11. The combination of claim 10 wherein said guard is of heat-treated metal material.

12. The combination of claim 10 including a rearwardly-disposed segment joined with said top and base portions and members.

13. The combination of claim 12 including a protective tab mounted upon at least one of said members at the open end of the guard slippable upon said staple or the like.

14. As a manufacture, a guard having an open end adapted for slip-on connection over a single element of a known locking combination and comprising a pair of spaced rigid members in secured relationship to each other, each of said members having a thickness through which an aperture is co-extensively disposed, each aperture in alignment with the other, said rigid members being spaced so as to constitute a void providing for the aforementioned slip-on connection, at least one rigid segment securing said members and maintaining them in such spaced relationship, said segment not being formed or disposed in the thickness of said members in which the aforementioned apertures are formed and disposed, and a face on each of said members at the open end of the guard and adapted for substantial physical abutment upon another element of the locking combination, said segment being in relationship with the aligned apertures and said spaced rigid members such that the single element of the locking combination substantially displaces such void when said guard is slipped over such single element and such single element lies between said rigid segment, members and the aligned apertures of said members.

15. The guard of claim 14 wherein at least one of said members is of heat-treated metal material.

16. The guard of claim 14 wherein said rigid segment is horizontally disposed between said members.

17. The guard of claim 16 wherein said segment joins together and secures said members at the end of said guard opposite its open end.

18. The guard of claim 17 wherein it is of heat-treated metal material.

19. The guard of claim 14 including a second rigid segment in opposite disposition to said one rigid segment and also joining together and maintaining said members in spaced relationship, said rigid segments constituting top and base portions of said guard.

20. The guard of claim 19 wherein it is of heat-treated metal material.

21. The guard of claim 19 including a rigid end portion opposite the open end of said guard and joining together and securing in spaced relationship said members and other portions of the guard.

22. The guard of claim 21 wherein it is of heat-treated metal material.

23. The guard of claim 14 including a rigid segment opposite the open end of said guard and which joins together and secures said one rigid segment and spaced members, the adaptation of the slip-on connection of the locking combination to the guard remaining the same.

24. The guard of claim 23 wherein it is of heat-treated metal material.

25. In a locking combination comprising a staple or the like having a cavity therein, a hasp slotted for a cooperative fit in a closed position to said staple or the like, and a shackle of a padlock or the like for insertion through such cavity with hasp in closed position to said staple or the like, the improvement for such combination comprising a guard having an open end for slip-on connection over said staple or the like upon the hasp being in closed position and comprising spaced rigid members in secured relationship to each other, each of said members having a thickness through which an aperture is co-extensively disposed, each aperture in alignment with the other, said rigid members being spaced so as to constitute a void providing for the afore-mentioned slip-on connection, at least one rigid segment securing said members and maintaining them in such spaced relationship, said segment not being formed or disposed in the thickness of said members in which the aforementioned apertures are formed and disposed, and a face on each of said members at the open end of the guard for substantial physical abutment upon the hasp in closed position, said segment being in relationship with the aligned apertures and said spaced rigid members such that the staple or the like of the locking combination substantially displaces such void when said guard is slipped over such staple or the like and such staple or the like element lies between said rigid segment, member and the aligned apertures of said members, the shackle thereafter being insertable through such aligned apertures and through such aligned apertures and through the cavity of the staple or the like, thereby making operative the guard in the combination.

26. In the improvement of claim 25, the guard being of heat-treated metal material.

27. In the improvement of claim 25, said rigid segment being horizontally disposed and securing said members and maintaining them in such spaced relationship.

28. In the improvement of claim 27, said segment being disposed at an end of said guard opposite to its open end for slip-on connection to the staple or the like.

29. In the improvement of claim 28, the guard being of heat-treated metal material.

30. In the improvement of claim 27, a second rigid segment in opposite disposition to said one rigid segment and also joining together and maintaining in spaced relationship said members, said segments constituting top and base portions of said guard.

31. In the improvement of claim 30, the guard being of heat-treated metal material.

32. In the improvement of claim 30, said guard including a rigid end portion opposite the open end of said guard and joining together and securing in spaced relationship said members and other portions of the guard.

33. In the improvement of claim 32, the guard being of heat-treated metal material.

34. In the improvement of claim 14, the guard including a rigid end portion opposite the open end of said guard and which joins together and secures said rigid segment and spaced members.

35. In the improvement of claim 34, the guard being of heat-treated metal material.

36. The combination of claim 1 wherein the aperture of each of said members is eccentrically disposed thereon.

37. The combination of claim 6 wherein the aperture of each of said members is eccentrically disposed thereon.

38. The combination of claim 10 wherein the aperture of each of said members is eccentrically disposed thereon.

39. The guard of claim 14 wherein the aperture of each of said members is eccentrically disposed thereon.

40. The guard of claim 19 wherein the aperture of each of said members is eccentrically disposed thereon.

41. In the combination of claim 25, the aperture of each of said members being eccentrically disposed thereon.

42. In the combination of claim 30, the aperture of each of said members being eccentrically disposed thereon.

* * * * *

UNITED STATES PATENT AND TRADEMARK OFFICE

CERTIFICATE OF CORRECTION

PATENT NO. : 4141232

DATED : February 27, 1979

INVENTOR(S) : Richard L. Kelly

It is certified that error appears in the above-identified patent and that said Letters Patent are hereby corrected as shown below:

Column 1, line 14, a comma (--,--) should appear after the period (--.--) following the "e" of the abbreviation "i.e." .

Column 3, line 37, a comma (--,--) should appear after "thickness".

Column 8, line 29, read "member" as -- members --.

Column 8, line 31, strike "and through such aligned".

Column 8, line 32, strike "apertures".

Column 8, line 60, "14" should be read as -- 25 --.

Signed and Sealed this

*Tenth* Day of *July 1979*

[SEAL]

*Attest:*

*Attesting Officer*

LUTRELLE F. PARKER

*Acting Commissioner of Patents and Trademarks*